US007247132B2

(12) United States Patent
Hugenholtz

(10) Patent No.: US 7,247,132 B2
(45) Date of Patent: Jul. 24, 2007

(54) PROCESS FOR PRODUCING A FLEXIBLE HOLDING SYSTEM

(75) Inventor: Patrick Hugenholtz, Sint-Martens-Latem (BE)

(73) Assignee: ConTeyor Multibag Systems N.V. (BE)

( * ) Notice: Subject to any disclaimer, the term of this patent is extended or adjusted under 35 U.S.C. 154(b) by 0 days.

(21) Appl. No.: 10/857,122

(22) Filed: May 28, 2004

(65) Prior Publication Data

US 2005/0075232 A1 Apr. 7, 2005

(30) Foreign Application Priority Data

May 31, 2003 (DE) ..... 103 24 785

(51) Int. Cl.
*B31B 17/00* (2006.01)
*B31B 1/00* (2006.01)

(52) U.S. Cl. ..... 493/480; 493/920

(58) Field of Classification Search ..... 383/38–40; 493/186, 197, 205, 480, 920
See application file for complete search history.

(56) References Cited

U.S. PATENT DOCUMENTS

| | | | | |
|---|---|---|---|---|
| 1,983,418 | A * | 12/1934 | Thurmer | 206/427 |
| 2,494,446 | A * | 1/1950 | Moore | 426/124 |
| 4,911,777 | A * | 3/1990 | Truc et al. | 156/252 |
| 5,046,860 | A * | 9/1991 | Brennan | 383/38 |
| 5,791,481 | A * | 8/1998 | Thomas | 206/581 |
| 5,930,956 | A | 8/1999 | Trosper et al. | |
| 6,070,629 | A | 6/2000 | Whiteside | |
| 2001/0006083 | A1 | 7/2001 | Haberkorn | |

FOREIGN PATENT DOCUMENTS

| | | | |
|---|---|---|---|
| DE | 3601390 | C1 | 8/1987 |
| DE | 9105966.6 | U1 | 8/1991 |
| DE | 4212836 | A1 | 10/1993 |
| DE | 4430694 | A1 | 4/1995 |
| WO | WO 90/09320 | A2 | 8/1990 |

* cited by examiner

*Primary Examiner*—Louis K. Huynh
*Assistant Examiner*—John Paradiso
(74) *Attorney, Agent, or Firm*—Stevens & Showalter L.L.P.

(57) ABSTRACT

The present invention relates to a process for producing a flexible holding system for transporting piece goods, consisting of an outer envelope (1, 1', 1'', 1''', 1'''') and intermediate elements (2) which each consist of a flexible web material, which are connected to one another such that compartments (3, 3', 3'', 3''', 3'''') are formed within the envelope (1, 1', 1'', 1''', 1''''). In order to provide a process for the cost-favorable and time-saving production of a flexible holding system, it is proposed according to the invention that firstly a long continuous tubular envelope (1, 1', 1'', 1''', 1'''') with intermediate elements (13, 14, 2', 13''', 14''', 19''') is made which is then divided transversely to the tube axis into at least two parts, so that at least two flexible holding systems result.

11 Claims, 3 Drawing Sheets

PROCESS FOR PRODUCING A FLEXIBLE HOLDING SYSTEM

Figure 1:
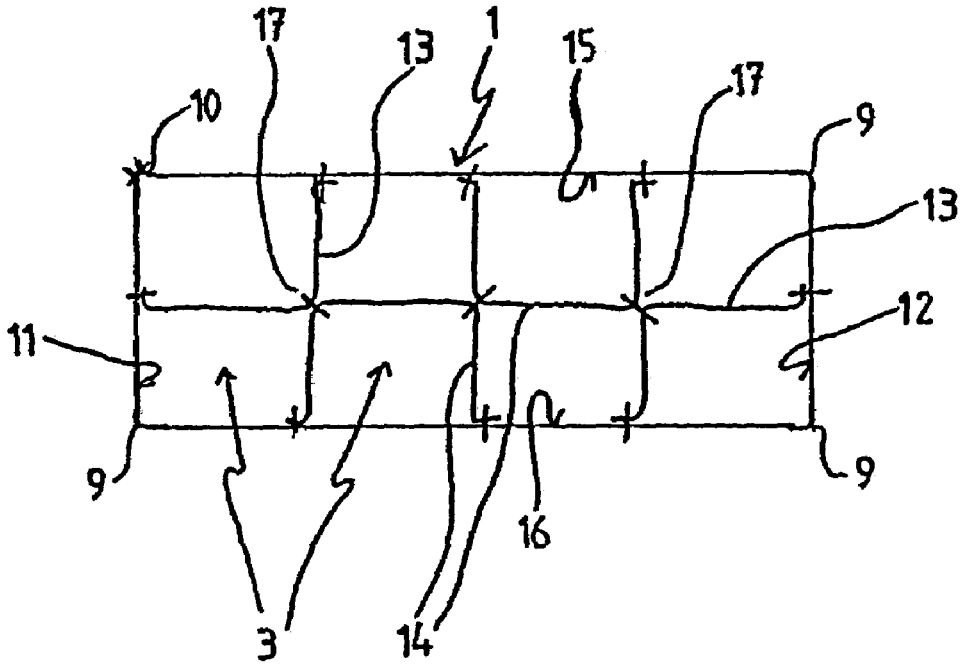

This application claims priority to German Patent Application 103 24 785.8, filed May 31, 2003.

The invention relates to a process for producing a flexible holding system for transporting piece goods, consisting of an outer envelope and intermediate elements. Both the outer envelope and the intermediate elements are made from a flexible web material. The envelope and the intermediate elements are connected to each other such that a compartmental division into which the piece goods can be loaded is formed inside the envelope.

In the transport industry, holding systems are known which make it possible to stow large numbers of piece goods in transport containers without the piece goods being damaged during transportation. It is known from the state of the art that such holding systems can be made from flexible web material. The web material is cut such that blanks that differ in length result. The blanks are glued, welded or sewn to one another so as to form an outer envelope with a flexible hollow section and a compartmental division or compartments or pockets in the inside of the envelope. The piece goods can be transported in the compartments or pockets. In this case e.g. a flexible envelope can first be made from the web material, the open faces of which mostly have a rectangular cross-section. The envelope extends downwards, so that a hollow section in the manner of a tube is formed. Further blanks of the web material are introduced into this tubular envelope as intermediate elements and connected to one another or to the envelope such that, among themselves or with the envelope, they form the compartments. Alternatively, the intermediate elements can be connected to each other first to form a compartmental division, and the cut-to-size webs which form the outer envelope are then attached to the compartmental division. There may also be cases in which the compartmental division is produced without an outer envelope.

In the current production process, in each case holding systems can only be made one after the other. This necessitates the handling of individual smaller blanks, which must each be individually aligned and connected to one another and to the envelope. The sewing machine must be reset for every single seam, which is time- and cost-intensive. The same applies when using other connection techniques for the machines used in this process.

Compared with the state of the art, the object of the invention is to provide a process for the cost-favorable and time-saving production of a flexible holding system.

The object is achieved in that firstly a long continuous envelope with a tubular hollow section and intermediate elements in its interior is made from flexible web material. The envelope and the intermediate elements are developed and used in a length which essentially corresponds to the sum of the lengths of the individual finished systems. Subsequently, in a second production step, the long continuous envelope with the compartmental division is divided into at least two parts by separation transversely to the longitudinal direction, so that at least two flexible holding systems with the desired lengths result. The longitudinal direction is defined as the direction which stands perpendicular on the opening of the hollow section. This procedure is advantageous, as the flexible web material for the envelope and the intermediate elements is made as yarded ware and can be cut into blanks in almost any lengths. The individual seams or other connections between the parts of the transport system can now be made continuously for a large number of systems, i.e. without stopping to reset the machine.

In a preferred version of the invention the holding systems are all the same size after the division. Alternatively, the holding systems can be of different sizes after the division. To use the conventional equipment when producing holding systems it is expedient to produce precisely two holding systems in one production run. This also makes it possible, in a particularly preferred version of the invention, to produce two holding systems in which the envelope is provided on one or more sides with overhanging excess material vis-à-vis the compartmental division, so that covers for sealing in each case one of the open faces of the two produced holding systems result. With this process two flexible holding systems that can be covered at least on one side can be produced, the seams of which can be produced without stopping to reset the machines.

It is expedient, for the separation of the holding systems, to use a cutting tool the blade of which has a high temperature. This makes possible for the cut edges to be sealed simultaneously with the cutting, so that these cannot fray.

Alternatively or additionally, the cut edges can be looped after the cutting. Thus a fraying of the material along the cut edges is effectively prevented.

Particularly advantageous is a version of the invention in which the seams in the area of the cut edges are triple-sewn. The seam in question is first produced some 1 cm to 2 cm beyond what is later the cut edge and the same spot is sown forward and back twice more.

A version of the invention is preferred in which the envelope with the intermediate elements is folded together flat for cutting. In this way, regular cut edges are achieved both at the envelope and at the compartment system and the cutting tool encounters the necessary resistance during cutting.

Figure 2:
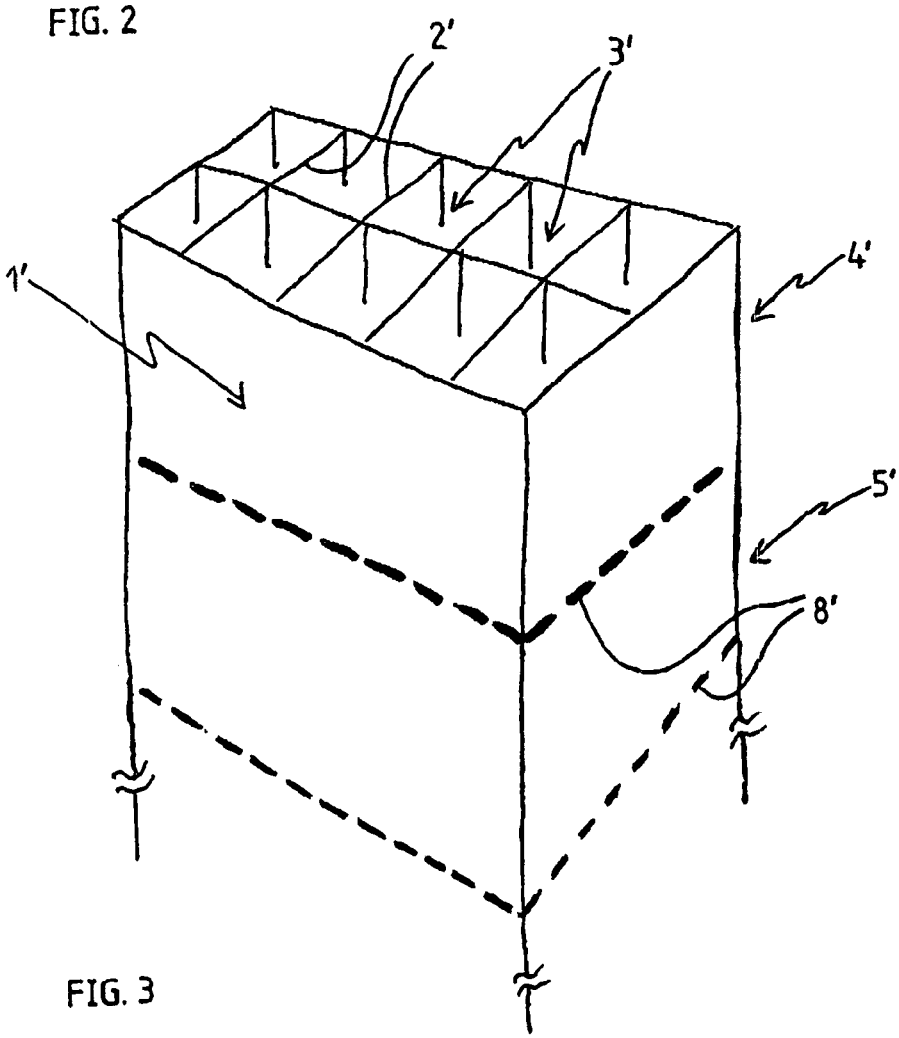
Figure 3:
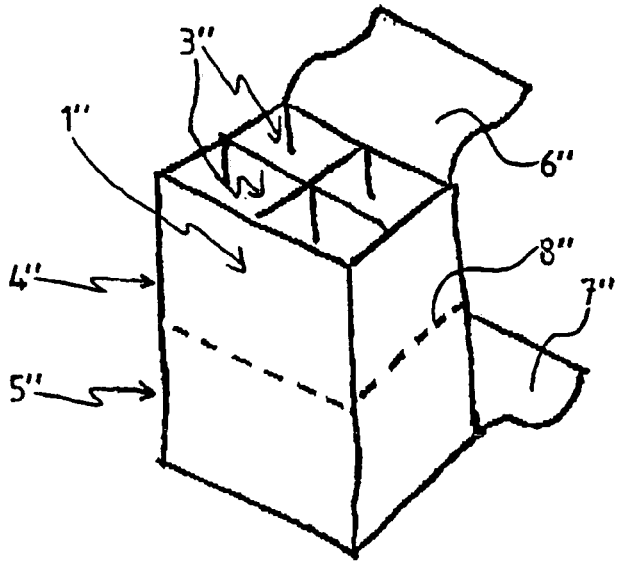
Figure 4:
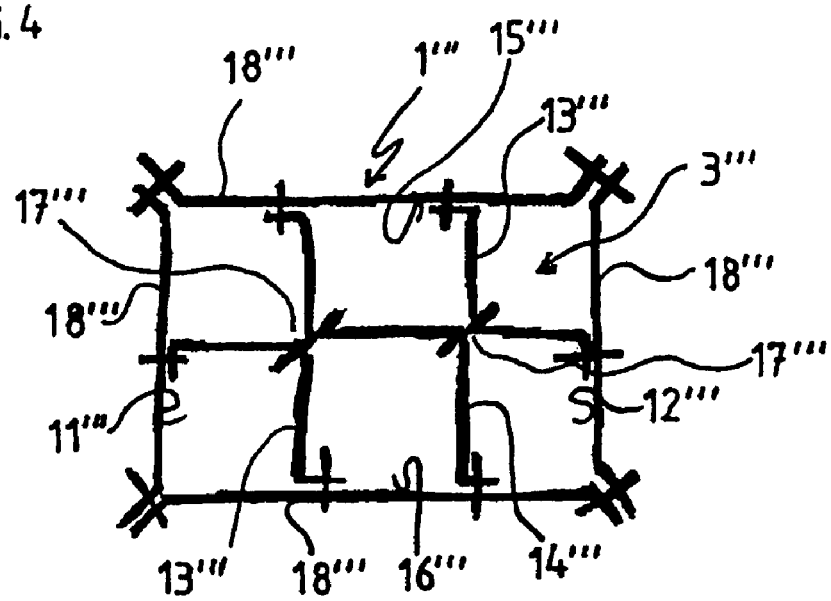
Figure 5:
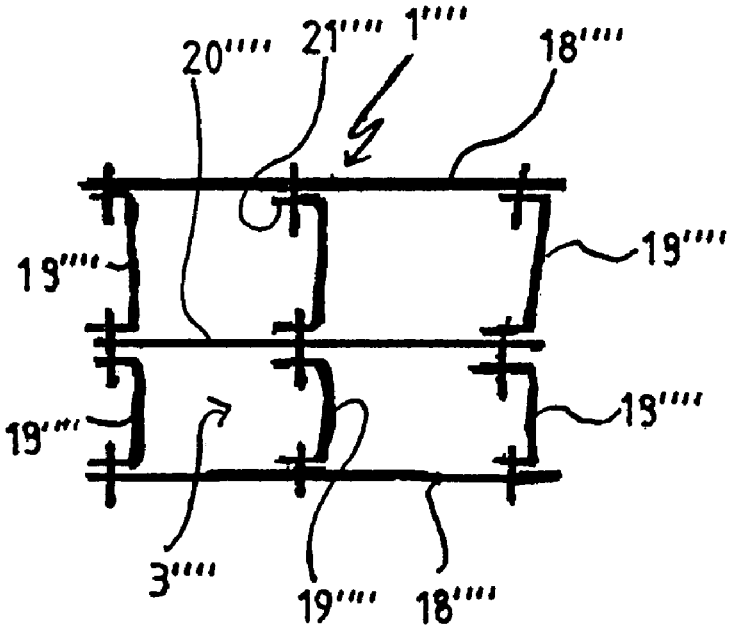

Further advantages, features and application possibilities of the present invention can be seen from the present description of a preferred version and the associated figures. There are shown in:

FIG. 1 a schematic view of the face of a flexible holding system,

FIG. 2 a three-dimensional view of the flexible holding systems before cutting, FIG. 3 a three-dimensional view of two holding systems with overhanging excess material before cutting, FIG. 4 a schematic view of the face of another embodiment of the holding system, FIG. 5 a schematic view of the face of a further embodiment of the holding system.

In FIG. 1 a version of a flexible holding system is shown by way of example. The distances between the individual parts of the holding system serve for better illustration. The envelope 1 is clearly recognizable. In the version shown it consists of a single piece of the flexible web material which is creased in three places, so that three edges 9 of the envelope 1 form. The fourth edge of the rectangular envelope is formed by sewing up the two ends of the web. Alternatively, the seam 10 can be replaced by a glued or welded connection. This applies equally to all the seam connections described below. Within the envelope, further pieces of web material, which are called intermediate elements, are now sewn in. At the sides of the envelope (left and right in FIG. 1) pieces 13 creased in an L shape are used, each being sewn on at the inner surfaces of the upper 15 and lower side 16 respectively of the envelope and at the inner surfaces 11 and 12 of the sides of the envelope. Rectangular compartments 3 result which are formed by the L-shaped intermediate elements 13 and the envelope 1. The remaining internal space of the envelope is now divided up by webs 14 creased in a U shape, so that further compartments 3 form. The legs of the U-shaped webs are sewn on at the inner surfaces of the upper 15 and lower side 16 respectively of the envelope 1. The creased edges of the U-shaped webs are attached by means of seams 17 to the creased edges of each of the intermediate elements adjoining them in each case. The shown development of the holding system consists of eight rectangular compartments 3. These can have other geometric shapes in other versions, e.g. square, triangular, or circular. The formed compartments 3 extend in the shown version over the whole depth of the tubular envelope 1, but in other versions the envelope 1 can have overhanging excess material vis-à-vis the compartments 3. It is understood that the sequence during the production of the individual seams (including welded and glued seams) can be chosen at will according to practical considerations. In general, those seams will presumably be produced first which, when the compartment cross-section is finished, lie furthest inside, the envelope being connected to the inner division and closed only at the end.

In FIG. 2 are shown the finished holding systems after the introduction and sewing up of the intermediate elements 2' into the tubular flexible envelope 1". The resulting rectangular compartments 3' are clearly to be seen inside the frame 1'. Alternatively, the compartments 3' can also be square, triangular or circular in shape. In the shown version, the holding system consists of ten compartments 3'. The formed tubular holding system in the form of yarded ware is now subsequently cut along the dotted lines 8'. For cutting, the holding system is folded flat and preferably pressed together along the cut edges. At least two holding systems 4' and 5' are thus obtained with the same distribution of the compartments 3' in their respective envelope 1'. In the shown preferred version, the holding systems are cut such that systems of equal size result.

By using a cutting apparatus with a blade which is raised to a high temperature, the cutting edges are sealed during cutting, so that they cannot fray later.

A further version of the invention is shown in FIG. 3. Again, a holding system has been produced which comprises an envelope 1", developed in the manner of a tube, with intermediate elements 2", so that compartments 3" result in the inside of the envelope 1". In the example shown, the tubular envelope is precisely long enough that, after cutting along the dotted line 8", precisely two holding systems 4" and 5" of equal size result. It is clearly to be seen that on both sides the upper side of the frame has overhanging excess material 6" and 7" respectively vis-à-vis the end of the envelope. The two overhangs 6" and 7" can be used, after the cutting, as covers to close the two holding systems 4" and 5".

FIG. 4 shows an alternative version, in which the outer envelope 1''' consists, not of a continuous web, but of four elements 18''' sewn up to one another. In each case pieces 13''' creased in an L-shape are used at the sides of the envelope (left and right in FIG. 4), each being sewn on at the inner surfaces of the upper 15''' and lower side 16''' respectively of the envelope and the inner surfaces 11''' and 12''' of the sides of the envelope. Square compartments 3''' result which are formed by the L-shaped intermediate elements 13''' and the envelope 1'''. The remaining internal space of the envelope is divided, in this version, by webs 14''' creased in meander shape, so that further compartments 3''' form. The legs of the meander-shaped webs 14''' are sewn on at one of their ends to the inner surfaces of the upper side 15''' and at their other end to the underside 16''' of the envelope 1'''. The creased edges of the meander-shaped webs 14''' are attached by means of seams 17''' to the creased edges of the intermediate elements adjoining in each case.

A further development of the invention is shown in FIG. 5. Here the outer envelope 1'''' is formed from six elements 18'''' and 19'''' respectively sewn up to one another. The upper and lower elements 18'''' respectively of the envelope and the base 20'''' arranged between then is formed from continuous webs. The webs 18'''', 20'''' are in each case connected to one another by intermediate elements 19'''' which form the walls of the compartments 3'''' and at the sides of the holding system simultaneously the side elements of the outer envelope 1''''. The folds 21'''' of the intermediate elements 19'''' which are sewn up with the webs 18'''', 20'''' all point in the same direction.

The invention claimed is:

1. Process for producing a flexible holding system for transporting piece goods, consisting of an outer envelope (1, 1', 1", 1''', 1'''') and intermediate elements (2) which each consist of a flexible web material, which are connected to one another along seams such that compartments (3, 3', 3", 3''', 3'''') are formed within the envelope (1, 1', 1 ", 1 ''', 1''''), characterized in that firstly a long continuous tubular envelope (1, 1', 1", 1''', 1'''') with intermediate elements (13,14, 2', 13''', 14''',19''') is made which is then divided transversely to the tube axis into at least two parts, so that at least two flexible holding systems result, and wherein the seams are arranged and stitched in an order such that for each seam being stitched, there remain at least two free edges on one side of the seam of the web materials being stitched.

2. Process for producing a flexible holding system according to claim 1, characterized in that the holding systems are all of the same size after cutting.

3. Process for producing a flexible holding system according to claim 1, characterized in that precisely two holding systems (4, 5') are produced.

4. Process for producing a flexible holding system according to claim 3, characterized in that the envelope (1') has, on one or more sides, overhanging excess material (6', 7') vis-à-vis the compartmental division, so that preferably two covers for sealing in each case one of the open faces of the two produced holding systems result.

5. Process for producing a flexible holding system according to claim 1, characterized in that the cuts are carried out at high temperatures with a cutting apparatus the blade of which is at a high temperature.

6. Process for producing a flexible holding system according to claim 1, characterized in that the cut edges are looped after cutting.

7. Process for producing a flexible holding system according to claim 1, characterized in that the seams in the area of the cut edges are triple-sewn.

8. Process for producing a flexible holding system according to one of claims 1 to 7, characterized in that the tubular envelope (1, 1', 1", 1''', 1'''') is folded flat with the compartmental division before cutting.

9. A process for producing a flexible holding system for transporting piece goods, comprising an outer envelope and intermediate elements, the outer envelope and intermediate elements each comprising a flexible web material, and the intermediate elements being connected to each other and to the outer envelope along seams to form a long continuous tubular envelope including compartments defined by the intermediate elements within the tubular envelope, wherein the order in which the seams are formed is such that for each seam being formed, there remain at least two free edges on one side of the seam of the web materials being formed, and wherein, upon completion of each compartment forming a closed compartment of the holding system, at least two free edges adjacent to a final seam of the compartment being completed are located outside of the compartment.

10. The process for producing a flexible holding system according to claim 9, characterized in that the seams comprise stitched seams.

11. The process for producing a flexible holding system according to claim 9, characterized in that the seams extend along a direction of elongation of the compartments.

* * * * *